United States Patent [19]

Peitsmeier

[11] 4,222,253

[45] Sep. 16, 1980

[54] STEERING LOCK FOR MOTOR VEHICLES

[75] Inventor: Karl Peitsmeier, Neuhausen, Fed. Rep. of Germany

[73] Assignee: Daimler-Benz Aktiengesellschaft, Fed. Rep. of Germany

[21] Appl. No.: 965,601

[22] Filed: Dec. 1, 1978

[30] Foreign Application Priority Data

Dec. 7, 1977 [DE] Fed. Rep. of Germany ..... 2754372

[51] Int. Cl.[2] ..... E05B 63/00

[52] U.S. Cl. ..... 70/417; 70/368

[58] Field of Search ..... 70/417, 368, 367, 416, 70/418, 451, 370, 371

[56] References Cited

U.S. PATENT DOCUMENTS

| | | | |
|---|---|---|---|
| 1,954,209 | 4/1934 | Jacobi | 70/368 |
| 3,795,123 | 3/1974 | Stiffel | 70/417 |

FOREIGN PATENT DOCUMENTS

| | | | |
|---|---|---|---|
| 2366072 | 9/1977 | Fed. Rep. of Germany | 70/368 |

*Primary Examiner*—Robert L. Wolfe

*Attorney, Agent, or Firm*—Craig & Antonelli

[57] ABSTRACT

A steering lock for motor vehicles which consists of a lock cylinder, of a housing and of a cover sleeve of tough material at least partially surrounding the housing, which is adjoined by a cap arranged within the area of the end face of the lock cylinder and which is provided with a recess along the inner wall, into which engages a safety catch against unauthorized removal of the cover sleeve; for the disassembly of the lock cylinder, the safety catch can be disengaged in a predetermined position of the key and therewith of the rotor of the lock cylinder; the cover sleeve is fastened to the housing by a threaded connection secured against an unscrewing and surrounds with play by means of a radially inwardly directed rim, a thick-walled cap retained at the front face of the rotor; the cap in turn is provided only with a closely fitting opening for the insertion of the key.

11 Claims, 8 Drawing Figures

FIG 1
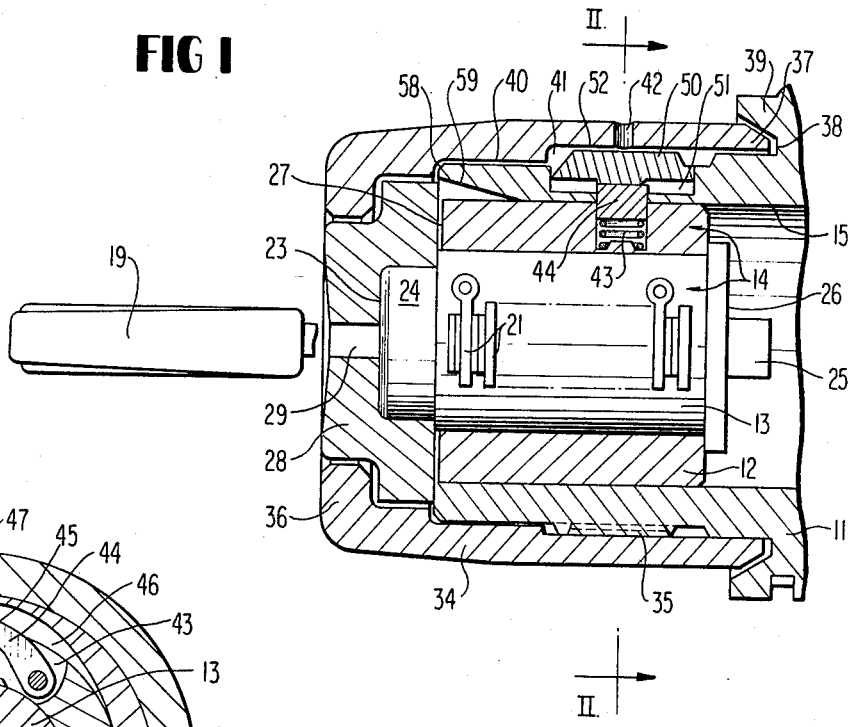
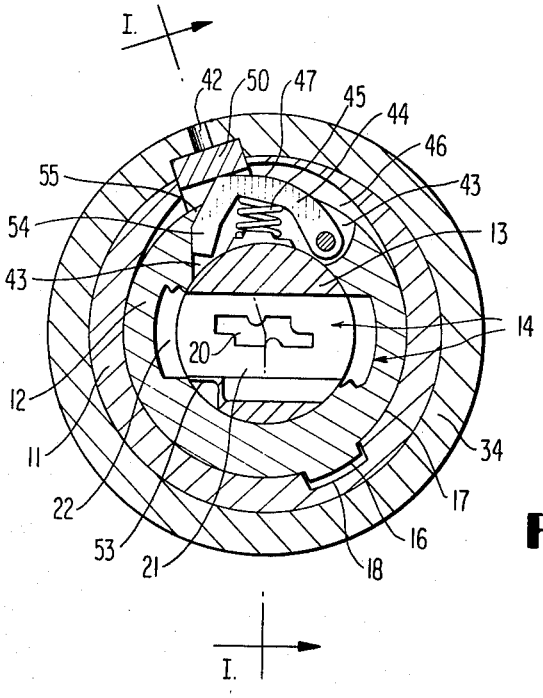
FIG 2
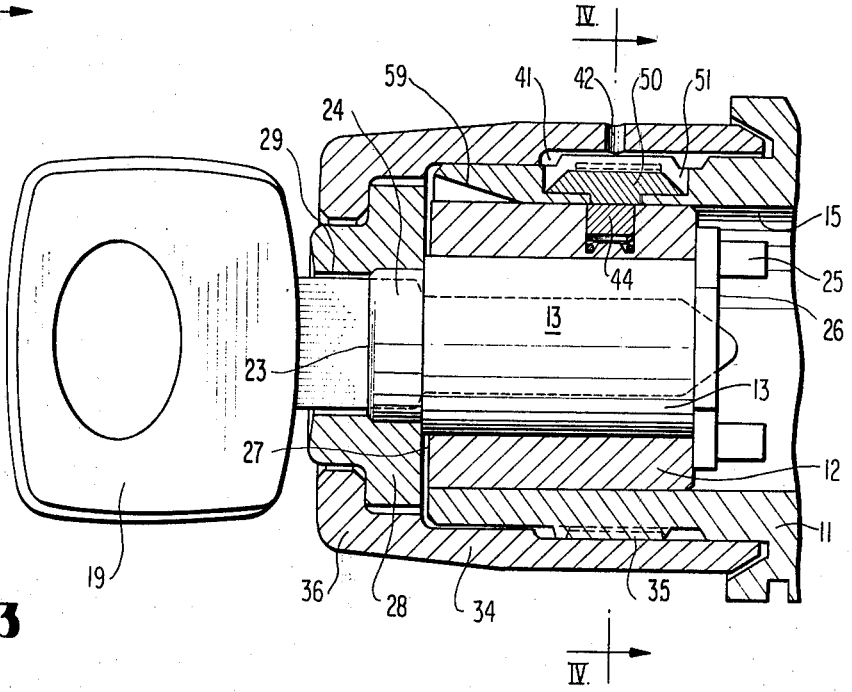
FIG 3

STEERING LOCK FOR MOTOR VEHICLES

The present invention relates to a steering lock for motor vehicles which consists of a lock cylinder, of a housing, and of a cover sleeve or casing of tough material at least partly surrounding the housing, which is adjoined by a cap arranged within the area of the end face of the lock cylinder and which is provided at the inner wall thereof with a recess, into which engages a locking pawl or safety catch against unauthorized removal of the cover sleeve, which for purposes of removal or disassembly of the lock cylinder, is adapted to be disengaged in a predetermined position of the key and therewith of the rotor of the lock cylinder.

In a prior art steering lock of this type (German Pat. No. 2,053,775) the cover sleeve or casing is secured at the housing by a pin, which projects out of the housing into an annular groove of the cover sleeve or casing. The cap adjoining the cover sleeve or casing is rigidly connected with the same. It includes a circularly shaped opening, which enables all rotary movement of the leaf-shaped key shank. The cap can therefore cover exclusively a narrow edge of the rotor and thus offers no protection against a boring-open of the rotor or against a screwing-in of an extracting tool, by means of which a forcible tearing-out of the rotor together with the cover sleeve or casing connected with the cap is possible, whereby the pin retaining alone the cover sleeve or casing digs into the cover sleeve or casing or is sheared off.

The present invention is concerned with the task to eliminate these shortcomings and to provide a steering lock which resists all opening attempts by forcible interaction such as, for example, by drilling-out or by tearing-out of the lock cylinder. This is achieved according to the present invention in that the cover sleeve or case is fastened at the housing by a threaded connection secured against unscrewing and surrounds with clearance by means of a radially inwardly directed rim a thick-walled cap made from tough material remaining at the front face of the rotor, which is provided exclusively with a closely fitting opening for the insertion of the key. The lock cylinder which is armored in this manner on all sides remains accessible only through the narrow gap of the key opening. As a result thereof, a drilling-open of the rotor is therefore no longer realizable. Also an extraction tool forced through the narrow key opening has in every case an insufficient tensile strength in order to overcome the screw connection at the housing circumference which retains the cover sleeve or casing together with the cap and therewith also the lock cylinder. An unscrewing of the cover sleeve or casing, however, is possible only in conjunction with the associated key as a result of the securing against rotation.

According to a further feature of the present invention, the steering lock includes a longitudinal groove in the cover sleeve or casing into which leads a bore for the insertion of a pin, a guidance in the housing in which a fitting spring is guided that projects into the longitudinal groove with a latched cover sleeve or casing, a locking pawl or safety catch which is supported in a recess of the stator of the lock cylinder and which is forced by a spring outwardly against the fitting spring, a recess in the housing into which extends the locking pawl with a latched cover sleeve or casing, and a recess in the rotor of the lock cylinder into which the locking pawl is adapted to engage for unlocking the cover sleeve or casing in a predetermined position of the key. These measures which produce a particularly effective securing and locking against an unauthorized rotation of the cover sleeve or casing, enable during repair and maintenance work an unlocking of the safety mechanisms with the aid of the associated key and a simple and rapid disassembly of the lock cylinder. The lock cylinder can subsequently be installed again in an equally simple manner. This is also true for the original installation at the manufacturer.

According to the present invention, the cap—without being able to transmit a considerable torque—may be retained only so securely at the rotor that the alignment of the key opening of the cap with the key guidance of the rotor is assured in normal use. An attempt to forcibly rotate the rotor in unison by rotation of the cap, for example, by means of a screwdriver inserted into the key opening, must fail because as a result of the slight retention of the cap at the rotor, the connection between these structural parts shears off long before a sufficient torque can be transmitted.

Accordingly, it is an object of the present invention to provide a steering lock for motor vehicles which avoids by simple means the aforementioned shortcomings and drawbacks encountered in the prior art.

Another object of the present invention resides in a steering lock for motor vehicles which offers an effective protection against unauthorized break-in into the vehicle.

A further object of the present invention resides in a steering lock for motor vehicles which offers a reliable protection against forcible opening by the use of drills or extraction tools seeking to forcibly tear out the rotor of the lock.

Still another object of the present invention resides in a steering lock of the type described above which effectively resists all attempts to open the same by forcible interactions.

A still further object of the present invention resides in a steering lock for motor vehicles which assures effective protection against unauthorized forcible opening of the lock, yet permits a rapid and easy assembly and disassembly thereof with the use of the associated key.

These and other objects, features and advantages of the present invention will become more apparent from the following description when taken in connection with the accompanying drawing which shows, for purposes of illustration only, one embodiment in accordance with the present invention, and wherein:

FIG. 1 is a longitudinal cross-sectional view through a steering lock according to the present invention with a locked cover sleeve or casing, taken along line I—I of FIG. 2;

FIG. 2 is a cross-sectional view taken along line II—II of FIG. 1;

FIG. 3 is a longitudinal cross-sectional view through the steering lock of FIG. 1, with an unlocked cover sleeve or casing, taken along line III—III of FIG. 4;

Figure 4:
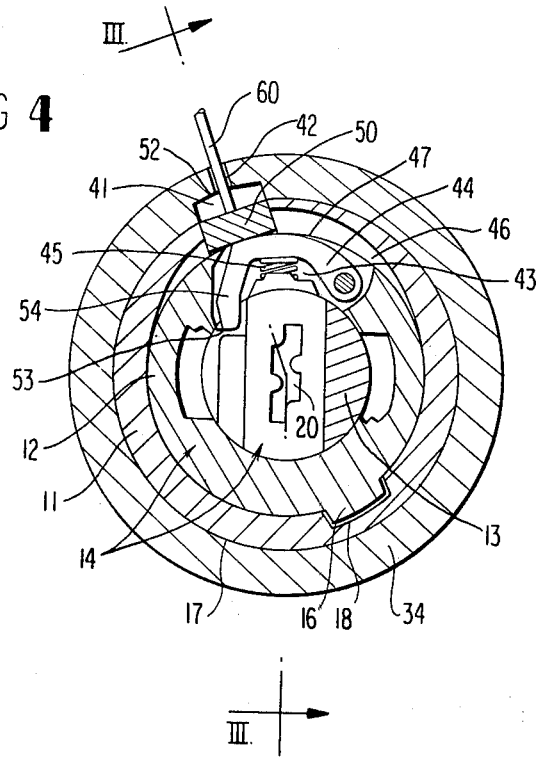
FIG. 4 is a cross-sectional view taken along line IV—IV of FIG. 3.

Referring now to the drawing wherein like reference numerals are used throughout the various views to designate like parts, as can be seen from FIGS. 1 and 2, the steering lock essentially consists of a housing 11, in which are accommodated the stator 12 and the rotor 13 of a lock cylinder generally designated by reference numeral 14. The housing 11 is rigidly connected with the motor vehicle within the area of the steering column. The stator 12 of the lock cylinder 14 is supported in a mounting bore 15 of the housing 11. A rotation of the stator 12 relative to the housing 11 is prevented by a ridge or key 16 (FIGS. 2 and 4) at the outer surface 17 of the stator 12, which engages in a longitudinal groove 18 within the housing 11. The rotor 13 rotatably supported in the stator 12, can be rotated after the insertion of the associated key 19 is the profiled key guidance 20. The rotor 13 accommodates in plate guidances 21 (FIGS. 1 and 2) the plate tumblers (not shown), which in the locked condition of the lock cylinder 14 engage in recesses 22 of the stator 12. The front face 23 of the rotor 13 is formed by a cylindrical extension 24 which projects out of the stator 12. Two entrainment members 25 at the back face 26 of the rotor 13 serve for the transmission of the rotary movements thereof to the locking mechanism (not shown) for the steering spindle and to the ignition starter switch connected therewith.

Figure 5:
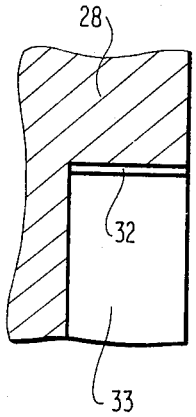
FIG. 5 is a partial longitudinal cross-sectional view, on an enlarged scale, illustrating a detail of the cap of the lock cylinder in accordance with the present invention.
Figure 6:
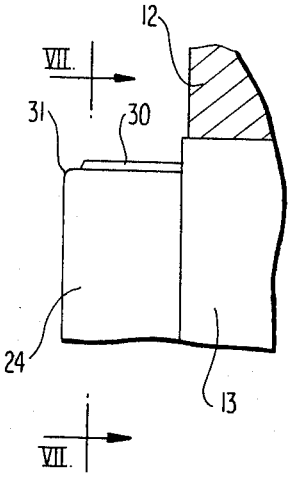
FIG. 6 is a partial longitudinal cross-sectional view, on an enlarged scale, illustrating a detail of the lock cylinder in accordance with the present invention.
Figure 7:
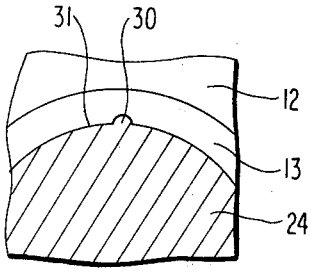
FIG. 7 is a cross-sectional view, taken along line VII—VII of FIG. 6.

The front faces 23 and 27 of the rotor 13 and of the stator 12 of the lock cylinder 14, respectively, are covered off by a thick walled cap 28 of hardened steel, which is interrupted only by a closely fitting key opening 29 (FIGS. 1 and 3) for the insertion of the key 19. The cap 28 is mounted over the cylindrical extension 24 of the rotor 13. Small cam-shaped projections 30 (FIGS. 6 and 7) at the outer surface 31 of the cylindrical extension 24 of a material of lesser strength are pressed into corresponding recesses 32 (FIG. 5) provided on the inside 33 of the cap 28. As a result thereof, the cap 28 remains in the correct position, in which the key opening 29 and the key guidance 20 are aligned with each other.

A thick walled cover sleeve or casing 34 of steel surrounds the lock cylinder 14 and the housing 11 and is connected with the latter by a threaded connection 35. The forward radially inwardly directed front edge 36 of the cover sleeve or casing 34 surrounds the cap 28 with clearance so that the rotary movements thereof are not impaired. The rear edge 37 of the cover sleeve or casing 34 engages in an annular groove 38 provided in a flange-like extension 39 at the housing 11 and can thus no longer be seized by means of a puller or extraction tool. A longitudinal groove 41 is machined into the inner wall 40 of the cover sleeve or casing 34. A bore 42 in the cover sleeve or casing 34 terminates in the longitudinal groove 41.

Figure 8:
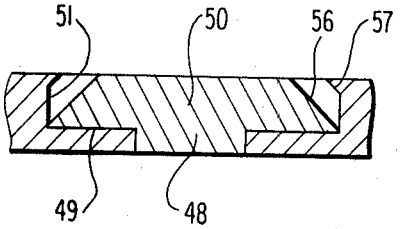
FIG. 8 is a longitudinal cross-sectional view, on an enlarged scale, illustrating a detail of the housing in accordance with the present invention.

An angularly bent locking pawl or safety catch 44 is supported in the stator 12 of the lock cylinder 14 within a recess 43 thereof. A coil spring 45, which is arranged in the recess 43 and operates as a compression spring, forces the safety catch or locking pawl 44 partly into an adjoining recess 46 in the housing 11, in which it abuts with its outside 47 (FIG. 2) at an extension 48 (FIG. 8) provided at the bottom side 49 of a fitting spring 50 which is supported in a radial guidance 51 within the housing 11. The guidance 51 is aligned with the longitudinal groove 41 in the cover sleeve or casing 34 so that a part of the fitting spring 50 engages in the longitudinal groove 41 under the pressure of the spring-loaded locking pawl 44 and abuts at the bottom 52 thereof. A recess 53 is provided in the rotor 13 of the lock cylinder 14, into which the end 54 of the locking pawl 44 is able to engage in a predetermined position of the rotor 13 (FIG. 4).

An abutment 55 (FIG. 2) is arranged at the edge of the recess 43 which limits the outward movement of the locking pawl or safety catch 44. The fitting spring 50 has inclined end surfaces 56 (FIG. 8), along which it is retained in its outermost position by abutments 57 at the edge of its guidance 51 and therewith cannot fall out. The abutments 57 can be formed after the insertion of the fitting spring 50 into the guidance 51 by wedging or peening over of the edge. An inclined deflecting surface 59 (FIGS. 1 and 3) for the locking pawl 44, which surface is disposed in the longitudinal plane of the guidance 51, starts from the end face 58 of the housing 11. The described measures facilitate the assembly and disassembly of the lock cylinder 14 at the manufacturer and in repair shops.

For purposes of assembly of the lock cylinder 14 into the housing 11 of the steering lock, the cover sleeve or casing 34 is placed over the lock cylinder 14 provided with the cap 28. The key 19 is inserted through the key opening 29 of the cap 28 into the key guidance 20 of the rotor 13. The lock cylinder 14 is slid into the mounting bore 15 by a slight amount in such a manner that the bar or ridge 16 at the stator 12 engages in the longitudinal groove 18 of the housing 11. The rotor 13 is thereupon displaced out of the position illustrated in FIG. 2 by rotation of the key 19 through 90° in the clockwise direction into the position corresponding to FIG. 4, in which the end 54 of the safety catch or locking pawl 44 is able to engage into the recess 53. If the lock cylinder 14 is pushed into the housing 11 when screwing on the cover sleeve or casing 34, then the part of the locking pawl 44 projecting out of the stator 12 slides along the inclined deflection surface 59 and is thereby forced inwardly into the recess 43, whereby the end 54 of the locking pawl 44 engages into the recess 53 (FIG. 4). The safety catch or locking pawl 44 which has now been pivoted completely into the recess 43 slides during the further screwing-in of the cover sleeve or casing 34 with its outside 47 in the mounting bore 15 until it is aligned with the recess 46 in the housing 11 and therewith engages into the same under the pressure of the coil spring 45 and therewith lifts the fitting spring 50 at its extension 48. If during the further rotation of the cover sleeve or casing 34, the longitudinal groove 41 thereof passes over the guidance 51 of the fitting spring 50, then the latter can engage into the longitudinal groove 41 under the pressure of the spring loaded locking pawl 44, whereby the end 54 of the locking pawl 44 is pivoted out of the recess 53. The cover sleeve or casing 34, as can be seen from FIGS. 1 and 2, is thus locked and can no longer be rotated.

If the steering lock is locked by rotation of the rotor 13 through 90° in the counterclockwise direction and by pulling out the key 19, then the rotor 13 assumes the position illustrated in FIG. 2. The recess 53 is now on the side of the rotor 13 opposite the locking pawl 44, in which the end 54 thereof can no longer engage into the recess 53. A radial inward movement of the fitting spring 50 is therefore no longer possible. The fitting spring 50 cannot be forced out of the longitudinal groove 41 of the sleeve or casing 34 also by the insertion of a pin through the bore 42. The cover sleeve or casing 34 is thus secured against an unauthorized unlocking.

The disassembly of the lock cylinder 14 takes place exactly in the reverse sequence. After the insertion of the key 19, the rotor 13 is rotated through 90° in the clockwise direction out of the position illustrated in FIG. 2 into the position according to FIG. 4, in which the recess 53 is disposed facing the end 54 of the locking pawl 44. The fitting spring 50 can now be forced out of the longitudinal groove 41 in the cover sleeve or casing 34 by means of a pin 60 inserted into the bore 42 against the pressure of the safety catch or locking pawl 44 spring-loaded by the coil spring 45, whereby the end 54 of the locking pawl 44 engages in the recess 53 (FIG. 4). The lock cylinder 14 is now so far pulled out of the housing 11 on the key 19, until the cap 28, as shown in FIG. 3, abuts at the inwardly directed edge 36 of the cover sleeve or casing 34. In this position, the outer surface 47 of the locking pawl 44 is partially overlapped by the mounting bore 15. Consequently, the coil spring 45 can no longer force the locking pawl 44 into the recess 46 within the housing 11. As a result thereof, the fitting spring 50 can no longer engage in the longitudinal groove 41. The cover sleeve or casing 34 can now be unscrewed without a re-engagement of the fitting spring 50 into the longitudinal groove 41 after each complete rotation. Thereupon, the lock cylinder 14 can be pulled completely out of the steering lock.

While I have shown and described only one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A steering lock for motor vehicles, comprising lock cylinder means having stator and rotor means, housing means, cover sleeve means of tough material at least partially surrounding the housing and lock cylinder means, and cap means adjoining the lock cylinder means within the area of the end face thereof, said cover sleeve means being provided at the inner wall thereof with a recess means, into which engages a locking pawl means against unauthorized removal of the cover sleeve means, said locking pawl means being disengageable for the disassembly of the lock cylinder means in a predetermined position of a key associated therewith and thus of the rotor means of the lock cylinder means, characterized in that the cover sleeve means is fastened at the housing means by a threaded connection secured against unscrewing and surrounds with play by means of a radially inwardly directed edge the cap means, said cap means being provided exclusively with a closely fitting opening for the insertion of the key.

2. A steering lock according to claim 1, characterized in that the cap means is relatively thick-walled, is made of tough material and is retained at the front face of rotor means.

3. A steering lock according to claim 2, characterized by a longitudinal groove in the cover sleeve means, into which leads a bore for the insertion of a pin, by a guide means in the housing means, in which is guided a fitting spring means which projects into the longitudinal groove when the cover sleeve means is locked, by a locking pawl means which is supported in a recess of the stator means of the lock cylinder means and which is forced outwardly against the fitting spring means by a spring, by a recess within the housing means, into which engages the locking pawl means with a locked cover sleeve means, and by a recess in the rotor means of the lock cylinder means into which the locking pawl means is operable to engage for unlocking the cover sleeve means in a predetermined position of the key.

4. A steering lock according to claim 3, characterized in that the cap means, without being able to transmit a significant torque, is retained at the rotor means of the steering lock means substantially only so securely that the alignment of the key opening of the cap means with the key guidance of the rotor means is assured in normal use.

5. A steering lock according to claim 4, characterized in that the cap means is provided along its inside with small recesses, into which are pressed-in corresponding projections of a material of lesser strength at the front face of the rotor means.

6. A steering lock according to claim 5, characterized in that the housing means is provided with a mounting bore, and in that an inclined deflection surface for the locking pawl means, which starts from the end face of the housing means, is provided in the mounting bore.

7. A steering lock according to claim 6, characterized in that the fitting spring means includes extensions, along which it is retained in its outermost position within its guide means by abutments.

8. A steering lock according to claim 2, characterized in that the cap means, without being able to transmit a significant torque, is retained at the rotor means of the steering lock means substantially only so securely that the alignment of the key opening of the cap means with the key guidance of the rotor means is assured in normal use.

9. A steering lock according to claim 4, characterized in that the cap means is provided along its inside with small recesses, into which are pressed-in corresponding projections of a material of lesser strength at the front face of the rotor means.

10. A steering lock according to claim 3, characterized in that the housing means is provided with a mounting bore, and in that an inclined deflection surface for the locking pawl means, which starts from the end face of the housing means, is provided in the mounting bore.

11. A steering lock according to claim 3, characterized in that the fitting spring means includes extensions, along which it is retained in its outermost position within its guide means by abutments.

* * * * *